US010650958B2

(12) United States Patent
Jo et al.

(10) Patent No.: US 10,650,958 B2
(45) Date of Patent: May 12, 2020

(54) COIL ELECTRONIC COMPONENT

(71) Applicant: SAMSUNG ELECTRO-MECHANICS CO., LTD., Suwon-si, Gyeonggi-do (KR)

(72) Inventors: Dae Hui Jo, Suwon-si (KR); Han Lee, Suwon-si (KR); Mi Sun Hwang, Suwon-si (KR); Jeong Min Cho, Suwon-si (KR); Myung Sam Kang, Suwon-si (KR); Seok Hwan Ahn, Suwon-si (KR); Tae Hoon Kim, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 223 days.

(21) Appl. No.: 15/232,325

(22) Filed: Aug. 9, 2016

(65) Prior Publication Data

US 2017/0301453 A1 Oct. 19, 2017

(30) Foreign Application Priority Data

Apr. 15, 2016 (KR) ..... 10-2016-0046375

(51) Int. Cl.
*H01F 27/28* (2006.01)
*H01F 17/00* (2006.01)
(Continued)

(52) U.S. Cl.
CPC ..... *H01F 27/2804* (2013.01); *H01F 17/0013* (2013.01); *H01F 27/292* (2013.01); *H01F 41/041* (2013.01); *H01F 2027/2809* (2013.01)

(58) Field of Classification Search
CPC ..... H01F 5/00; H01F 27/28; H01F 27/2804; H01F 27/292
(Continued)

(56) References Cited

U.S. PATENT DOCUMENTS 4,758,808 A * 7/1988 Sasaki ..... H01F 17/04 333/185
6,713,162 B2 * 3/2004 Takaya ..... H03H 7/0115 428/209
(Continued)

FOREIGN PATENT DOCUMENTS

JP 05-308023 11/1993
JP 2002-184638 A 6/2002
(Continued)

OTHER PUBLICATIONS

Korean Office Action issued in Korean Application No. 10-2016-0046375 dated May 22, 2017, 18 pages.
(Continued)

*Primary Examiner* — Tszfung J Chan
(74) *Attorney, Agent, or Firm* — Morgan, Lewis & Bockius LLP

(57) ABSTRACT

A coil electronic component includes a body portion and an external electrode. The body portion includes a coil layer and a reinforcing layer disposed on at least one of an upper portion and a lower portion of the coil layer. The external electrode is disposed on an outer surface of the body portion. The coil layer includes an insulating layer, a coil pattern, and a first conductivity type via penetrating through the insulating layer to be connected to the coil pattern, and the reinforcing layer has a higher degree of rigidity than the insulating layer.

32 Claims, 13 Drawing Sheets

(51) Int. Cl.
*H01F 27/29* (2006.01)
*H01F 41/04* (2006.01)

(58) Field of Classification Search
USPC ..... 336/200, 232
See application file for complete search history.

(56) References Cited

U.S. PATENT DOCUMENTS 8,201,318 B2 * 6/2012 Yamano ..... H01F 17/0013 29/602.1
2008/0180206 A1 * 7/2008 Fouquet ..... H01F 19/08 336/200
2008/0257488 A1 10/2008 Yamano
2009/0153282 A1 * 6/2009 Taoka ..... H01F 17/0013 336/200
2009/0251268 A1 * 10/2009 Sato ..... B32B 18/00 336/200
2011/0037557 A1 2/2011 Konoue et al.
2014/0306792 A1 * 10/2014 Yoneda ..... H01F 27/2804 336/200
2014/0333407 A1 11/2014 Sun et al.
2015/0009003 A1 * 1/2015 Ozawa ..... H01F 17/0013 336/200
2015/0091685 A1 * 4/2015 Kitajima ..... H01F 17/0013 336/192
2015/0097648 A1 * 4/2015 Kido ..... H01F 17/0013 336/200
2015/0102890 A1 * 4/2015 Nakamura ..... H01F 27/2804 336/200
2015/0340150 A1 * 11/2015 Nakamura ..... H01F 27/24 336/200
2016/0351321 A1 * 12/2016 Lyoo ..... H01F 27/2804
2017/0287622 A1 * 10/2017 Ishizaki ..... H01F 27/323

FOREIGN PATENT DOCUMENTS

JP 2002-359141 A 12/2002
JP 2002-368524 A 12/2002
JP 2004-296860 A 10/2004
JP 2004296860 A * 10/2004
JP 2004296860 A * 10/2004
JP 2005-277385 A 10/2005
JP 2009-130325 A 6/2009
JP 2009-152347 A 7/2009
JP 2009152347 A * 7/2009
JP 2009-277972 A 11/2009
JP 2010-165975 A 7/2010
JP 4816971 B2 11/2011
JP 2012-069754 A 4/2012
JP 2013-131687 A 7/2013
JP 2015-19108 A 1/2015
JP 2015-39026 A 2/2015
JP 2016-001734 A 1/2016
KR 2010-0101012 A 9/2010
WO 2013-146568 A1 10/2013

OTHER PUBLICATIONS

Office Action issued in corresponding Japanese Patent Application No. 2016-098855 dated Feb. 18, 2020, with English translation.

* cited by examiner

COIL ELECTRONIC COMPONENT

CROSS-REFERENCE TO RELATED APPLICATION

This application claims benefit of priority to Korean Patent Application No. 10-2016-0046375 filed on Apr. 15, 2016 in the Korean Intellectual Property Office, the disclosure of which is incorporated herein by reference in its entirety.

BACKGROUND

1. Field

The present disclosure relates to a coil electronic component.

2. Description of Related Art

Inductors, including coil electronic components, are electronic circuit components that are commonly used together with resistors and condensers for the removal of noise or to configure LC resonant circuits, and the like. Various types of inductors, such as multilayer inductors, wound inductors, thin film inductors, and the like, may be used according to a coil type thereof.

In general, an inductor includes a coil that is embedded in a body formed of an insulating material. According to recent demand for miniaturized devices having a range of performance levels, attempts to form fine coil patterns have been undertaken. In the case of the insulating material, since the insulating material has a relatively low degree of rigidity, product reliability may be reduced in manufactured products.

SUMMARY

An aspect of the present disclosure is to provide a coil electronic component having improved structural stability and reliability. The coil electronic component may have miniaturized components and a fine coil pattern, and may exhibit a relatively high degree of rigidity by employing a body portion having a protective layer.

A further aspect of the present disclosure is to provide a method of effectively manufacturing a coil electronic component having the structure described above using a batch lamination method.

According to an aspect of the present disclosure, a coil electronic component having a novel structure is provided. The coil electronic component may include a body portion including a coil layer and a reinforcing layer disposed on at least one of an upper portion and a lower portion of the coil layer, and an external electrode disposed on an outer surface of the body portion. The coil layer may include an insulating layer, a coil pattern, and a first conductivity type via penetrating through the insulating layer to be connected to the coil pattern, and the reinforcing layer may have a higher degree of rigidity than the insulating layer.

The insulating layer may include a photosensitive insulating material.

The coil layer may further include a connection pattern disposed in a corner of the insulating layer to be connected to the external electrode.

The body portion may include a plurality of coil layers laminated in a stacking direction, each of the plurality of coil layers may include an insulating layer, a coil pattern, a first conductivity type via penetrating through the insulating layer to be connected to the coil pattern, and a connection pattern disposed in a corner of the insulating layer, and each of the plurality of coil layers may further include a second conductivity type via penetrating through the insulating layer to be connected to the connection pattern.

The coil pattern and the connection pattern may be connected to each other in an uppermost coil layer and in a lowermost coil layer of the plurality of coil layers.

The coil pattern and the connection pattern may be disconnected from each other in each of the plurality of coil layers other than the uppermost coil layer and the lowermost coil layer.

The second conductivity type via may include a copper (Cu) layer and a tin (Sn) layer laminated together.

The second conductivity type via in each respective coil layer may be disposed in the respective coil layer in a position which does not overlap with a position of other second conductivity type vias included in coil layers adjacent to the respective coil layer in a lamination direction.

The second conductivity type via may have an integrated structure penetrating through all of the plurality of coil layers.

The connection pattern may have an 'L' shape when viewed from above.

The coil electronic component may further include a pad layer disposed between the coil layer and the reinforcing layer, the pad layer including a connection pattern connected to the external electrode and not including a coil pattern.

The coil pattern may be partially embedded in the insulating layer and a surface of the coil pattern may be exposed through a surface of the insulating layer.

A Young's modulus of the reinforcing layer may be 12 GPa or more.

The first conductivity type via may include a Cu layer and a Sn layer laminated together.

The first conductivity type via may further include an intermetallic compound disposed at an interface between the Sn layer and the coil pattern.

The body portion may have a structure that is asymmetrical in a vertical direction around a central surface of the body portion.

The body portion may further include a plurality of coil layers laminated in a stacking direction, and a core portion disposed in a central portion of the laminated stack of coil layers, and the coil layers may be disposed on upper and lower portions of the core portion.

Among the coil layers, first conductivity type vias included in the coil layers disposed on upper and lower portions of the core portion may be disposed in surfaces of the coil layers facing the core portion.

The core portion may be a copper-clad laminate.

According to another aspect of the present disclosure, a method of manufacturing a coil electronic component may include providing a plurality of coil layers each including an insulating layer, a coil pattern, and a first conductivity type via penetrating through the insulating layer to be connected to the coil pattern; providing a reinforcing layer having a higher degree of rigidity than the insulating layer; forming a body portion by batch laminating the plurality of coil layers and laminating the reinforcing layer on at least one of an upper portion and a lower portion of the plurality of coil layers; and forming an external electrode on an outer surface of the body portion.

The providing of the plurality of coil layers may include forming the coil pattern on a surface of a carrier layer, forming the insulating layer to cover the coil pattern, and forming the first conductivity type via penetrating through the insulating layer to be connected to the coil pattern.

The providing of the plurality of coil layers may further include separating the carrier layer from the coil layers.

The coil layers may be formed on both an upper surface and a lower surface of the carrier layer.

According to a further aspect of the disclosure, a coil electronic component may include a body portion including a coil layer and a reinforcing layer disposed on at least one of an upper portion and a lower portion of the coil layer. The coil layer may include an insulating layer and a coil pattern, and the reinforcing layer may have a higher content of a ceramic filler than the insulating layer.

The insulating layer may include a mixture of the ceramic filler and a photosensitive material, the reinforcing layer may include the ceramic filler and an insulating resin, and a content of the ceramic filler in the reinforcing layer may be higher than a content of the ceramic filler in the insulating layer.

The body portion may include a plurality of coil layers laminated in a stacking direction, and each of the plurality of coil layers may include an insulating layer, a coil pattern, and a first conductivity type via penetrating through the insulating layer to be connected to the coil pattern.

The first conductivity type via in each respective coil layer may be disposed in the respective coil layer in a position which does not overlap with a position of other first conductivity type vias included in coil layers adjacent to the respective coil layer in a lamination direction.

Each of the plurality of coil layers may further include a connection pattern disposed in a corner of the insulating layer, and a second conductivity type via penetrating through the insulating layer to be connected to the connection pattern.

The second conductivity type via in each respective coil layer may be disposed in the respective coil layer in a position which does not overlap with a position of other second conductivity type vias included in coil layers adjacent to the respective coil layer in a lamination direction.

The body portion may include a plurality of coil layers laminated in a stacking direction, and a core portion disposed in a central portion of the laminated stack of coil layers, wherein the coil layers are disposed on upper and lower portions of the core portion.

A Young's modulus of the reinforcing layer may be 12 GPa or more.

In accordance with another aspect of the disclosure, a coil electronic component may include a body portion including a plurality of coil layers laminated in a stacking direction, and a reinforcing layer disposed on at least one of an upper portion and a lower portion of the laminated stack of coil layer. Each respective coil layer may include an insulating layer, a coil pattern, and a first conductivity type via penetrating through the insulating layer and disposed in the respective coil layer in a position which does not overlap with a position of other first conductivity type vias included in coil layers adjacent to the respective coil layer in the stacking direction.

The reinforcing layer may have a higher degree of rigidity than the insulating layer.

Each of the plurality of coil layers may further include a connection pattern disposed in a corner of the insulating layer, and the first conductivity type via may penetrate through the insulating layer to be connected to the connection pattern.

Each first conductivity type via may penetrate through the insulating layer to be connected to the coil pattern. Further, each of the plurality of coil layers may further include a connection pattern disposed in a corner of the insulating layer, and a second conductivity type via penetrating through the insulating layer to be connected to the connection pattern. The second conductivity type via in each respective coil layer may be disposed in the respective coil layer in a position which does not overlap with a position of other second conductivity type vias included in coil layers adjacent to the respective coil layer in a lamination direction.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
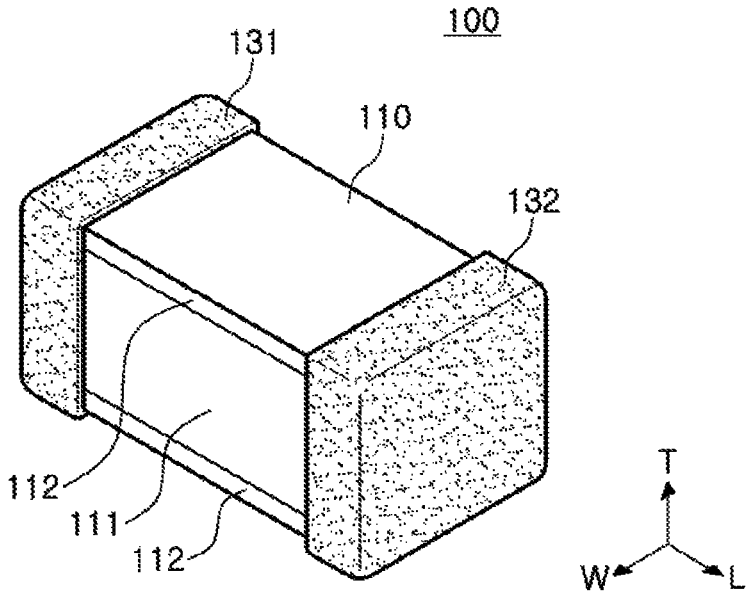
FIG. 1 is a perspective view of a coil electronic component according to an exemplary embodiment.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers, and/or sections, these members, components, regions, layers, and/or sections should not be limited by these terms. These terms are only used to distinguish one member, component, region, layer, or section from another member, component, region, layer, or section. Thus, a first member, component, region, layer, or section discussed below could be termed a second member, component, region, layer, or section without departing from the teachings of the embodiments.

Spatially relative terms, such as "above," "upper," "below," "lower," and the like, may be used herein for ease of description to describe one element's positional relationship relative to one or more other elements as shown in the figures. It will be understood that the spatially relative terms are intended to encompass different orientations of the device in use or operation in addition to the orientation depicted in the figures. For example, if the device in the figures is turned over, elements described as "above" or "upper" relative to other elements would then be oriented "below" or "lower" relative to the other elements or features. Thus, the term "above" can encompass both the above and below orientations depending on a particular direction of the devices, elements, or figures. The device may be otherwise oriented (e.g., rotated 90 degrees or at other orientations) and the spatially relative descriptors used herein may be interpreted accordingly.

The terminology used herein describes particular illustrative embodiments only, and the present disclosure is not limited thereby. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, members, elements, and/or groups, but do not preclude the presence or addition of one or more other features, integers, steps, operations, members, elements, and/or groups.

Hereinafter, embodiments will be described with reference to schematic views illustrating the embodiments. In the drawings, components having ideal shapes are shown. However, variations from these ideal shapes, for example due to variability in manufacturing techniques and/or tolerances, also fall within the scope of the disclosure. Thus, embodiments of the present disclosure should not be construed as being limited to the particular shapes of regions shown herein, but should more generally be understood to include changes in shape resulting from manufacturing methods and processes. The following embodiments may also be constituted by one or a combination thereof.

The present disclosure describes a variety of configurations, and only illustrative configurations are shown herein. However, the disclosure is not limited thereto, but extends to other similar/analogous configurations as well.

Coil Electronic Component

Figure 2:
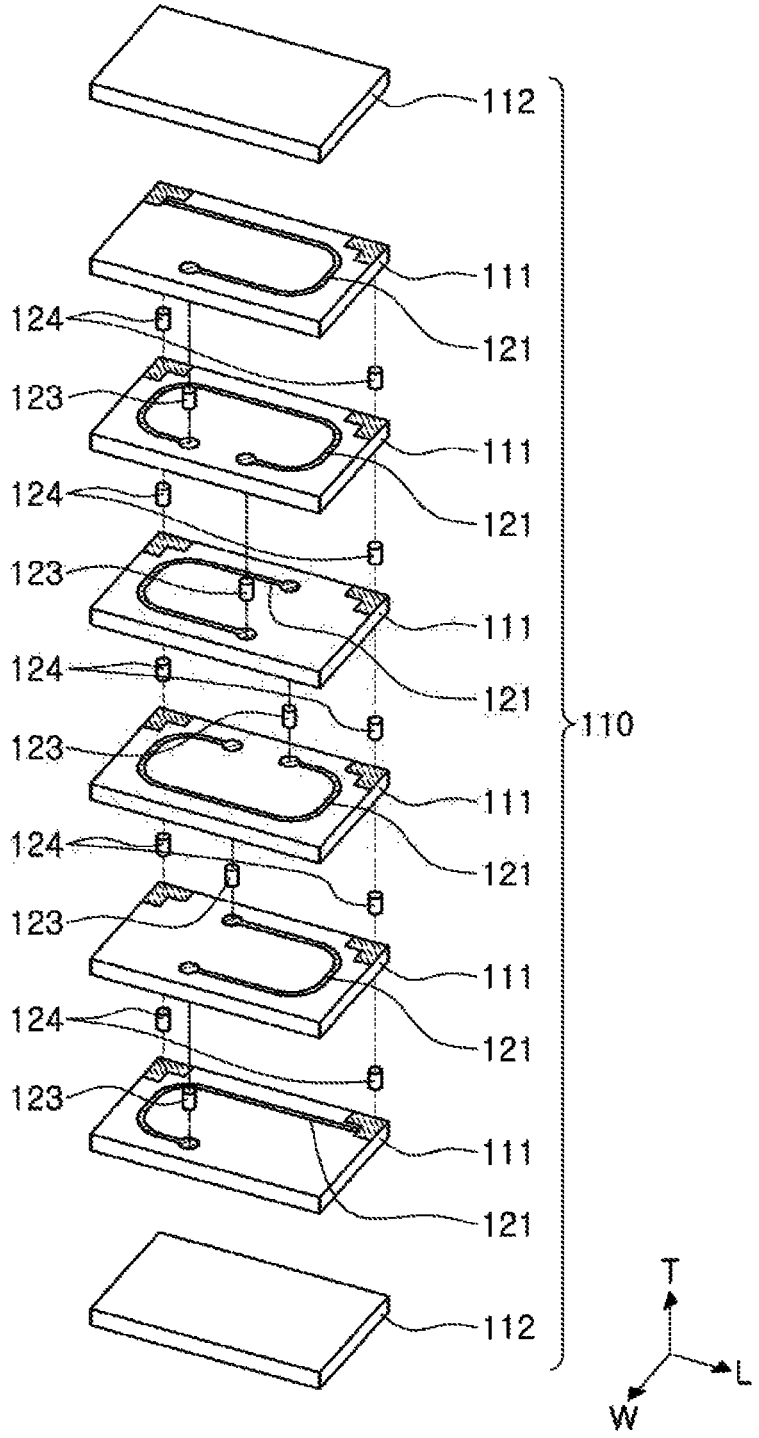
FIG. 2 is a schematic exploded perspective view of a body portion that may be employed in the exemplary embodiment of FIG. 1.
Figure 3:
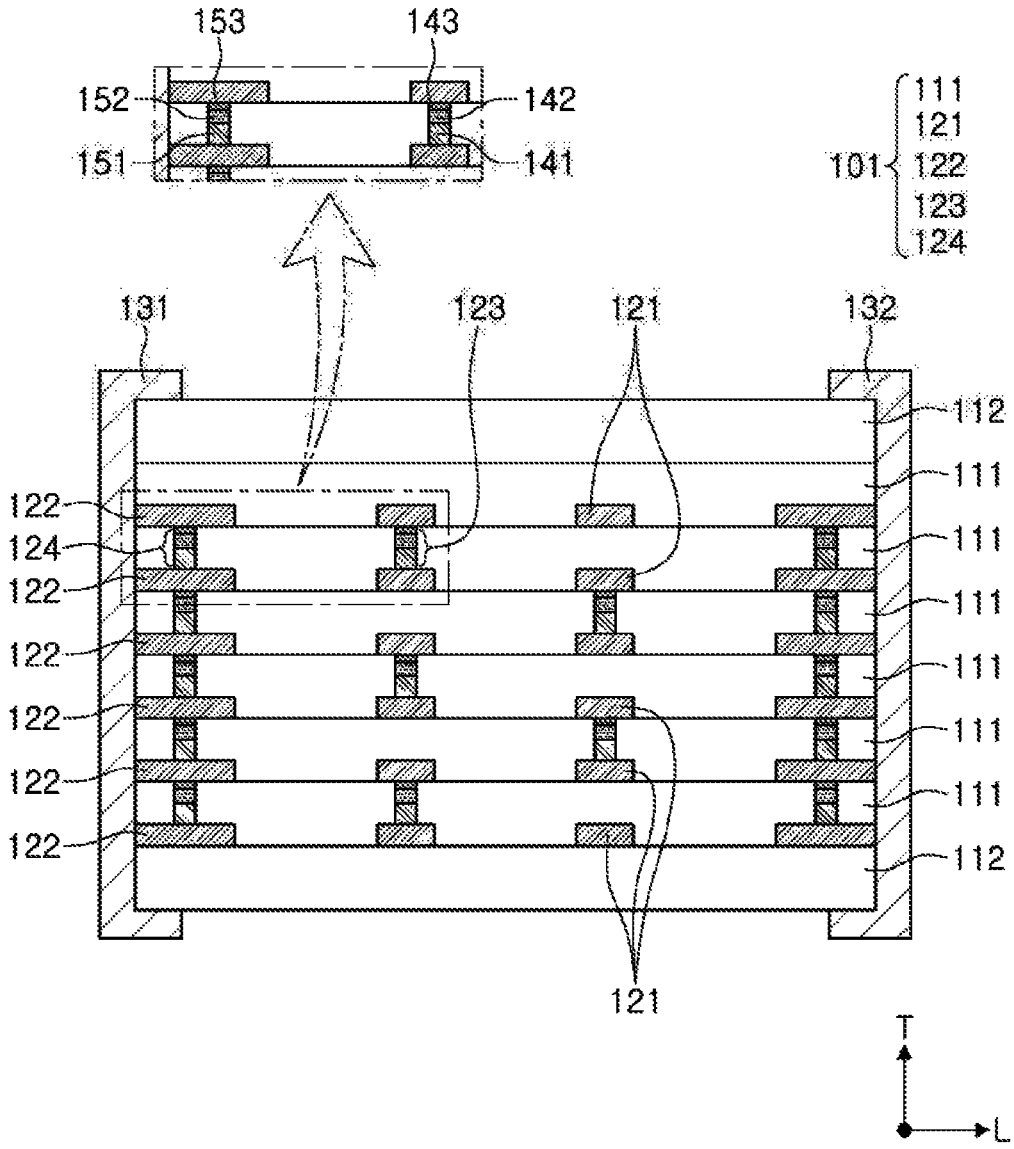
FIG. 3 is a cross-sectional view of a coil electronic component according to the exemplary embodiment of FIG. 1, in which first conductivity type vias and connection patterns are shown.
Figure 4:
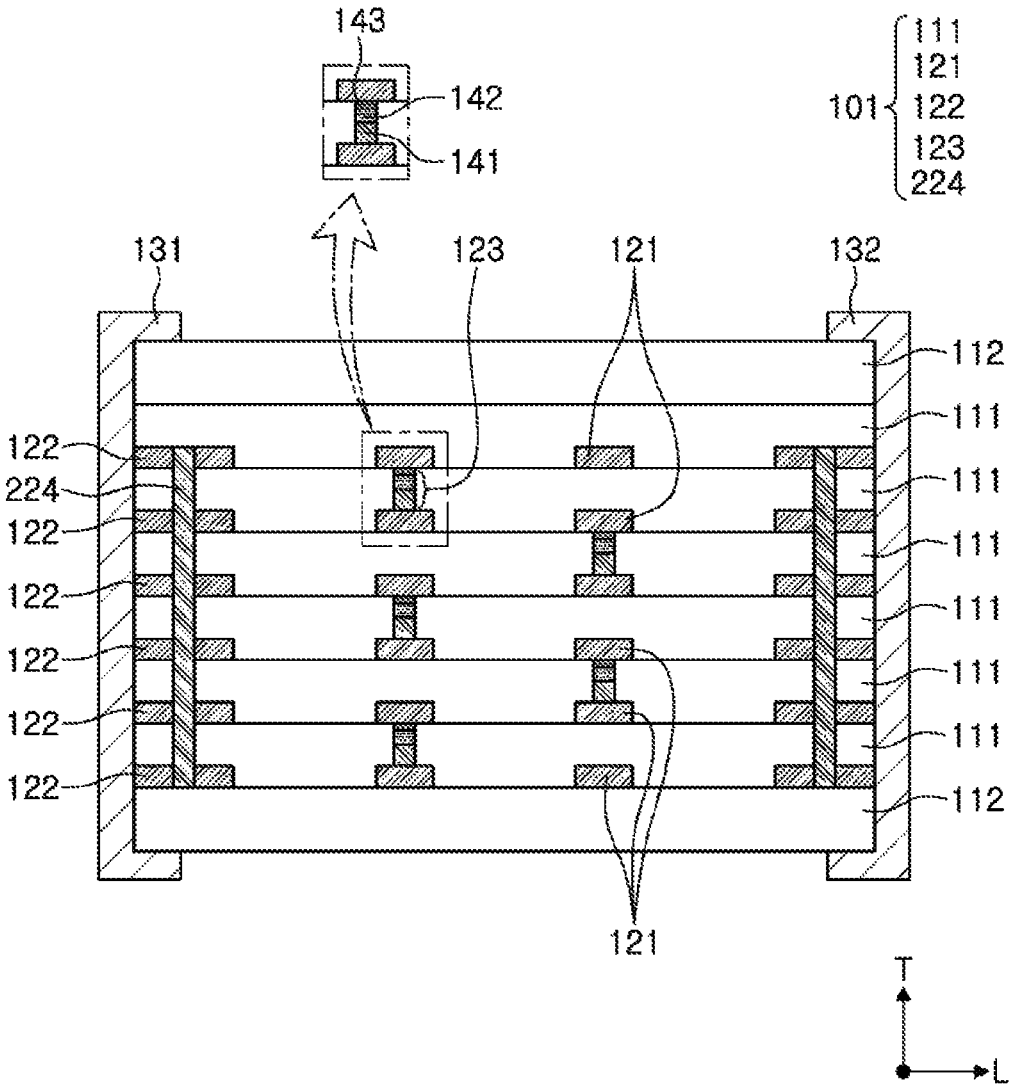
FIGS. 4 to 7 illustrate modified embodiments of coil electronic components according to exemplary embodiments.

FIG. 1 is a perspective view of a coil electronic component according to an exemplary embodiment. FIG. 2 is a schematic exploded perspective view of a body portion that may be employed in the exemplary embodiment of FIG. 1. FIG. 3 is a cross-sectional view of a coil electronic component, in which a first conductivity type via and a connection pattern are shown, according to the exemplary embodiment of FIG. 1.

First, with reference to FIGS. 1, 2 and 3, a coil electronic component 100 may include a body portion 110 and external electrodes 131 and 132 formed on external surfaces of the body portion 110. The body portion 110 may include one or more coil layer(s) 101 and one or more reinforcing layer(s) 112. The reinforcing layer 112 may have a higher degree of rigidity than that of an insulating layer 111 forming the coil layer 101 to improve structural stability of the body portion 110. The reinforcing layer 112 may be disposed on upper and lower portions (or surfaces) of the coil layer 101 as illustrated in FIG. 3. Further, in other examples, the reinforcing layer 112 may be disposed on only one of the upper and lower portions (or surfaces) of the coil layer 101.

The external electrodes 131 and 132 may be provided as a pair, and may be disposed in positions opposing each other in a length direction of the body portion 110. The external electrodes 131 and 132 may be connected to coil patterns 121 of the body portion 110, and connection patterns 122 may be provided therebetween as described below. As a detailed form of the external electrodes 131 and 132, for example, a structure may be used that includes an outermost layer that is a tin (Sn) plating layer, and a nickel (Ni) plating layer disposed below the outermost layer.

Hereinafter, a detailed structure of the body portion 110 will be described with reference to FIGS. 2 and 3.

The coil layer 101 may be provided as a plurality of coil layers laminated or stacked in a single direction. Each coil layer 101 may include an insulating layer 111, a coil pattern 121, and a first conductivity type via 123 penetrating the insulating layer 111 to be connected to the coil pattern 121. In such a form, the coil pattern 121 of the coil layer 101 may form a coil having an axis aligned with the lamination direction (e.g., such that a direction of a magnetic field resulting from current flow through the coil flows in parallel to the lamination direction).

As a material of the insulating layer 111, a material appropriately selected from among materials that may be used as a material of a body portion of an inductor may be used. For example, a resin, ceramic, ferrite, or the like may be used. In the case of the exemplary embodiment, as a material of the insulating layer 111, a photosensitive insulating material may be used, by which a fine pattern may be implemented through a photolithography process. In detail, as the insulating layer 111 is formed using a photosensitive insulating material, the first conductivity type via 123, the coil pattern 121, and the like may be formed finely, to thus contribute to miniaturization and functional improvement of the coil electronic component 100. To this end, for example, a photosensitive organic material or a photosensitive resin may be included in the insulating layer 111. In addition, an inorganic component such as $SiO_2/Al_2O_3/BaSO_4$/Talc, or the like may be further included as a filler component in the insulating layer 111.

The coil pattern 121 may be obtained by patterning a high conductive metal in the form of a coil, for example, through a tenting method using copper (Cu) foil etching, a semi-additive process (SAP) using Cu plating, a modified semi-additive process (MASP), or the like. In the case of a metal used for the formation of the coil pattern 121, copper (Cu), silver (Ag), paladium (Pd), aluminum (Al), nickel (Ni), titanium (Ti), gold (Au), platinum (Pt), or the like, may be used alone or a mixture thereof may be used. On the other hand, as illustrated in FIG. 3, the coil pattern 121 may be partially embedded in the insulating layer 111 in such a manner that one surface thereof may be exposed, which may be obtained in a process in which respective coil layers 101 are separately manufactured, described below. Here, a structure in which one surface of the coil pattern 121 is exposed may indicate that the coil pattern 121 is exposed to a surface of the insulating layer 111 having the same surface level as that of the coil pattern 121. In addition, by using a method in which the coil layers 101 are separately prepared and laminated, the body portion 110 may have a structure that is asymmetrical in a vertical direction. In detail, as illustrated in FIG. 3, the body portion 110 may have a vertical structure that is asymmetrical in which the coil layer 101, the coil pattern 121, and the like are included. For example, the structure of the body portion 110 may be such that the coil pattern 121 is asymmetrically disposed in the vertical direction on opposing sides of a central surface of the body portion 110.

The first conductivity type via 123 may be provided to connect the coil patterns 121 disposed on different layers of the plurality of insulating layers 111 to each other, and may be formed to have a multilayer structure as illustrated in FIG. 3. In detail, the first conductivity type via 123 may include a structure in which a Cu layer 141 and an Sn layer 142 are laminated. The Cu layer 141 and the Sn layer 142 may be obtained through a plating process suitable therefor. In this case, an intermetallic compound 143 may be formed at an interface between the Sn layer 142 and the coil pattern 121. In case of using a printed circuit board (PCB) technology of a general build-up scheme, since a conductive via is formed of a metal, i.e. of the same material as a material of a circuit pattern, an intermetallic compound is not provided. However, as described below, in the case of using a batch lamination method, a material forming the coil pattern 121 and a material forming the first conductivity type via 123 (for example, Sn) are diffused and combined to exhibit effective electrical connection. However, the first conductivity type via 123 is not limited to a multilayer structure as in the exemplary embodiment, and may also be configured of a single layer structure.

As described above, the reinforcing layer 112 disposed outside of the coil layer 101 to form a cover of the body portion 110 may have a higher degree of rigidity than that of the insulating layer 111. In a case in which a photosensitive material is used to implement a fine pattern, the rigidity of the insulating layer 111 may be lowered, and the reinforcing layer 112 may prevent the reduction in the rigidity. The reinforcing layer 112 may include a filler formed of ceramic or the like. As a relatively large amount of the filler is included therein as compared to that in the insulating layer 111, a relatively high degree of rigidity may be obtained. In a case in which rigidity of the reinforcing layer 112 is higher than that of the insulating layer 111, the performance (such as the rigidity) of the reinforcing layer 112 may be implemented. As an example of detailed characteristics, a Young's modulus of the reinforcing layer 112 may be about 12 GPa or more. In addition, although the exemplary embodiment illustrates that one reinforcing layer 112 is respectively laminated on each of the upper and lower portions (or surfaces) of the body portion 110, the number of reinforcing layers 112 laminated on the upper and lower portions may be increased as needed. For example, a plurality of reinforcing layers 112 may be disposed on the same position.

On the other hand, in the exemplary embodiment, the coil layer 101 may include the connection patterns 122 formed on corners of the insulating layer 111 to be connected to the external electrodes 131 and 132. The coil patterns 121 and the external electrodes 131 and 132 may be stably connected with each other by the connection patterns 122 while improving electrical characteristics thereof. As in the coil pattern 121, each connection pattern 122 may be formed using a material such as Cu or the like, and may have an 'L' shape disposed at a corner of the coil layer 101 when viewed from above as illustrated in FIG. 2. Due to the 'L'-shaped connection patterns 122, coupling force thereof with the external electrodes 131 and 132 may be improved.

In addition, in order to connect the connection patterns 122 disposed on different layers to each other, the coil layer 101 may include second conductivity type vias 124 penetrating through the insulating layers 111 to be connected to the connection patterns 122. In this case, the second conductivity type via 124 may have a structure similar to or the same as that of the first conductivity type via 123. In detail, the second conductivity type via 124 may have a lamination structure in which a Cu layer 151 and an Sn layer 152 are laminated, and an intermetallic compound 153 may be formed at an interface thereof with the connection pattern 122 connected to the Cu layer and the Sn layer.

As illustrated in FIG. 2, in the uppermost and lowermost coil layers among the plurality of coil layers 101 of the body portion 110, the coil pattern 121 and the connection pattern 122 are connected to each other. In contrast, in the remaining coil layers (for example, the four coil layers disposed in the middle of the body portion 110, and other than the uppermost and lowermost coil layers among the plurality of coil layers 101), the coil pattern 121 and the connection pattern 122 are not connected to each other.

On the other hand, although the exemplary embodiment of FIG. 2 illustrates a device in which one pair of connection patterns 122 are formed in each respective coil layer 101 so as to be connected to one of the pair of external electrodes 131 and 132, the number of the connection patterns 122 may be changed. For example, the connection patterns 122 may be formed in all of four corners of each insulating layer 111.

In addition, the positions in which the connection patterns 122 are located as illustrated in FIG. 2 may also be changed. For example, each pair of connection patterns 122 may be formed in two corners of the insulating layer 111 opposing each other in a diagonal direction thereof. In addition, in the exemplary embodiment, although the second conductivity type vias 124 are each disposed in a same predetermined position in each insulating layer 111 to as to be aligned with each other in a lamination direction, the positions of the second conductivity type vias 124 may be changed as required. This will be described with reference to FIGS. 8 and 9.

Figure 8:
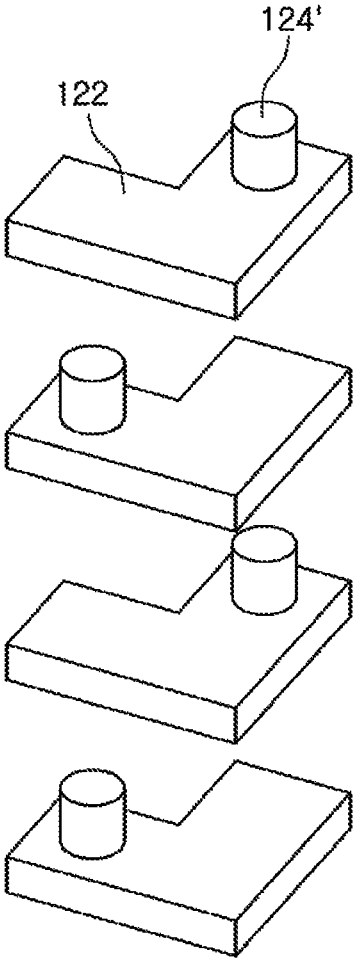
FIGS. 8 and 9 are perspective views schematically illustrating shapes or forms of connection patterns employed in a coil electronic component according to an exemplary embodiment in the present disclosure.
Figure 9:
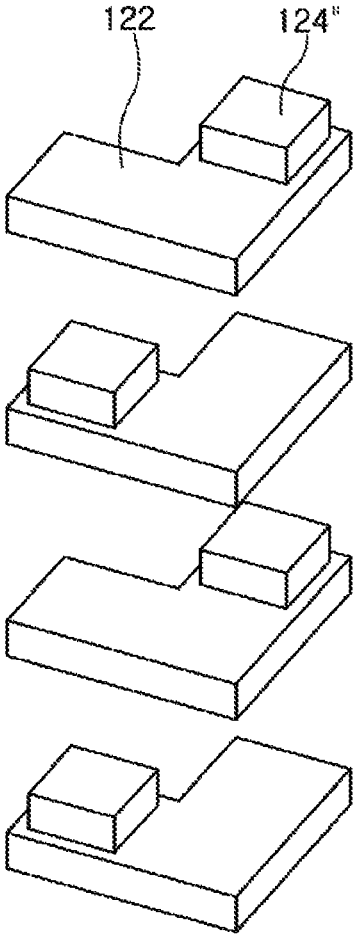

FIGS. 8 and 9 are perspective views schematically illustrating the shapes or forms of connection patterns employed in a coil electronic component according to exemplary embodiments of the present disclosure. In modified examples, respective second conductivity type vias 124' or 124" may be disposed so as not to overlap each other, while being included in adjacent different coil layers (e.g., 101), in a lamination direction. As an example thereof, the second conductivity type vias 124' or the second conductivity type vias 124" may be arranged in a zigzag arrangement in alternating locations in a lamination direction as respectively illustrated in FIGS. 8 and 9.

In the case of the zigzag arrangement, pressure applied by the second conductivity type vias 124' and 124" may be dispersed, and thus, a process variable, having a negative influence on the body portion, such as a thickness deviation or the like, occurring in the body portion 110, may be reduced. In detail, in the case of a multilayer inductor, a relatively large degree of change in inductor characteristics may occur according to a respective distance between the coil layers 101, a thickness of the coil patterns 121, and the like. For example, the insulating layer 111 and a conductive layer such as the coil pattern 121 and the like may have different hardnesses and modulus characteristics or the like. Thus, deviations in thickness of the body portion 110 may occur when the body portion is pressed using heat and pressure, but may be prevented by disposing the second conductivity type vias 124' or 124" in a zigzag arrangement.

On the other hand, the second conductivity type vias 124' may have a cylindrical shape as illustrated in FIG. 8, or in a different manner, the second conductivity type vias 124"

may have a quadrangular pillar shape to further increase a contact area thereof as illustrated in FIG. 9.

Hereinafter, modified examples of the present disclosure will be described with reference to FIGS. 4 to 7. The description of FIGS. 4 to 7 will focus on elements that are modified or different from the foregoing exemplary embodiment. First, in the case of the exemplary embodiment with reference to FIG. 4, the shape or form of the second conductivity via 224 may be altered relative to that shown in relation to FIGS. 1-3. In detail, to obtain an interlayer connection between the connection patterns 122, the second conductivity type via 224 may be provided having an integrated structure in which the via 224 penetrates through multiple of (or the entirety of) the plurality of coil layers 101. To this end, and in contrast with a process that will be described below, a via connected to the connection pattern 122 may not be formed separately in each individual coil layer 101 when the individual coil layer 101 is manufactured. Instead, the via 224 may be formed after the coil layers 101 are laminated together. The via 224 may be formed by forming a through hole penetrating through the laminated stack of coil layers 101 and by filling the through hole with a material such as Cu or the like through a plating process. The second conductivity type via 224 may thus penetrate through the plurality of coil layers 101 so as to be connected to the connection patterns 122 of each coil layer 101.

Figure 5:
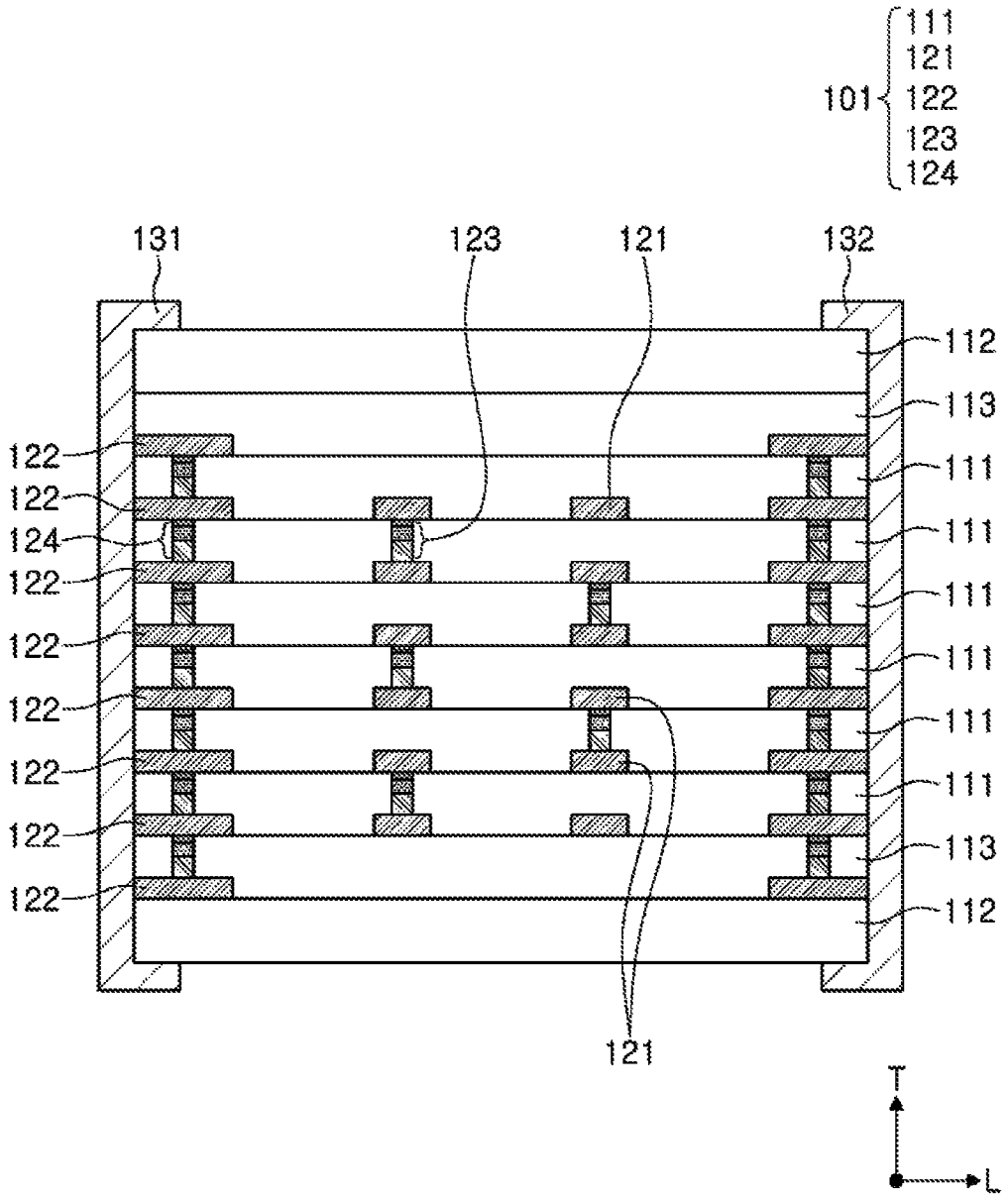

Next, in the case of the exemplary embodiment shown in FIG. 5, a pad layer 113 may be added to the foregoing exemplary embodiment. The pad layer 113 may be disposed between the coil layer 101 and the reinforcing layer 112 at the top and/or at the bottom of the laminated stack of the plurality of coil layers 101. The pad layer 113 may be similar to the coil layer 101 in terms of including the connection patterns 122 connected to the external electrodes 131 and 132. However, the pad layer 113 may not include the coil pattern 121. The pad layer 113 may be employed to control a size of the coil layer 101, the number of turns of the coil pattern 112, or the like, while maintaining (or setting) a size of the coil electronic component 100.

Subsequently, in the exemplary embodiment shown in FIG. 6, a core portion 201 may be further included to increase structural stability. In detail, the core portion 201 may be disposed in a middle portion of the body portion 110, and coil layers 101' may be disposed on upper and lower portions (or surfaces) of the core portion 201. The core portion 201 may include base portions 202, a conductive pattern 203 formed on surfaces of the base portions to be connected to the coil pattern 121 and the connection pattern 122, and through wire(s) 204 extending through the base portions 202 to connect the conductive pattern 202 disposed on the different surfaces of the base portions 202. As an element having such a form, a copper-clad plate (CCL) may be used, and then processed to be suitable therefor, thus forming the core portion 201.

Figure 6:
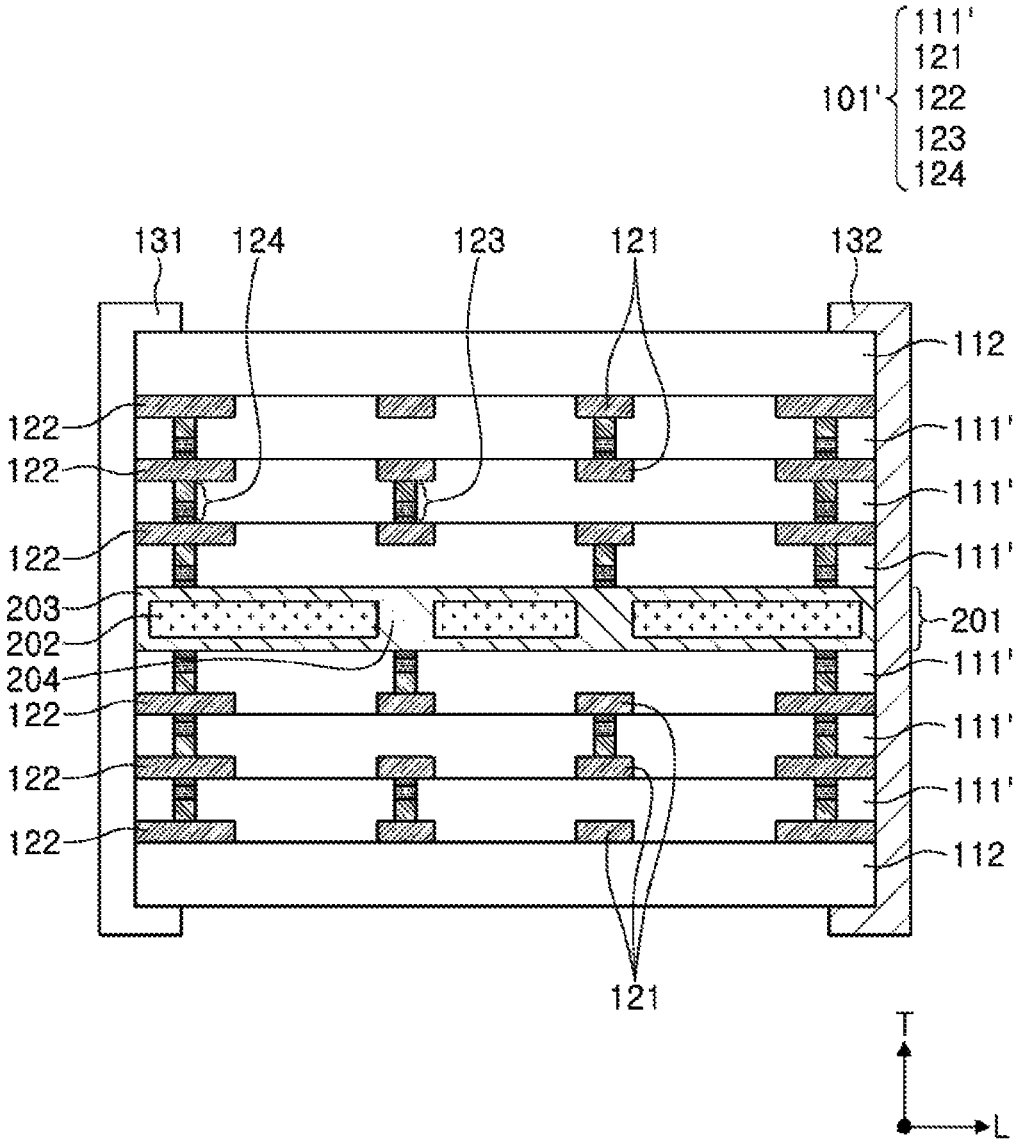

In the case of the modified example using the core portion 201 as shown in FIG. 6, in all of the upper coil layers disposed on the core portion 201, for example the three coil layers disposed on the core portion in FIG. 6, and in the lower coil layers disposed below the core portion 201, for example the three coil layers disposed below the core portion in FIG. 6, the first conductivity type vias 123 included therein may be disposed to extend toward the core portion 201. The disposition arrangement as described above may be employed to obtain a further stable connection structure in a case in which a plurality of the coil layers 101' are manufactured and then laminated, based on the core portion 201 provided in the middle.

In the example of FIG. 6, the coil layers 101' are stacked or laminated such that the coil patterns 121 formed on each of the coil layers 101' are formed on surfaces of the coil layers 101' facing away from the core portion 201. As such, the coil patterns 121 are formed on upper surfaces of the coil layers 101' disposed on (or above) the core portion 201, while the coil patterns 121 are formed on lower surfaces of the coil layers 101' disposed below the core portion 201. The first conductivity type vias 123 disposed in the coil layers 101' disposed on (or above) the core portion 201 thus extend from the coil patterns 121 to the lower surfaces of the coil layers 101', while the first conductivity type vias 123 disposed in the coil layers 101' disposed below the core portion 201 extend from the coil patterns 121 to the upper surfaces of the coil layers 101'. In an alternative example, the coil patterns 121 could instead be formed on lower surfaces of the coil layers 101' disposed on (or above) the core portion 201, while the coil patterns 121 would then be formed on lower surfaces of the coil layers 101' disposed below the core portion 201. The first conductivity type vias 123 disposed on (or above) the core portion 201 in the alternative example would then extend from the coil patterns 121 to the upper surfaces of the coil layers 101', while the first conductivity type vias 123 disposed in the coil layers 101' disposed below the core portion 201 would extend from the coil patterns 121 to the lower surfaces of the coil layers 101'.

Figure 7:
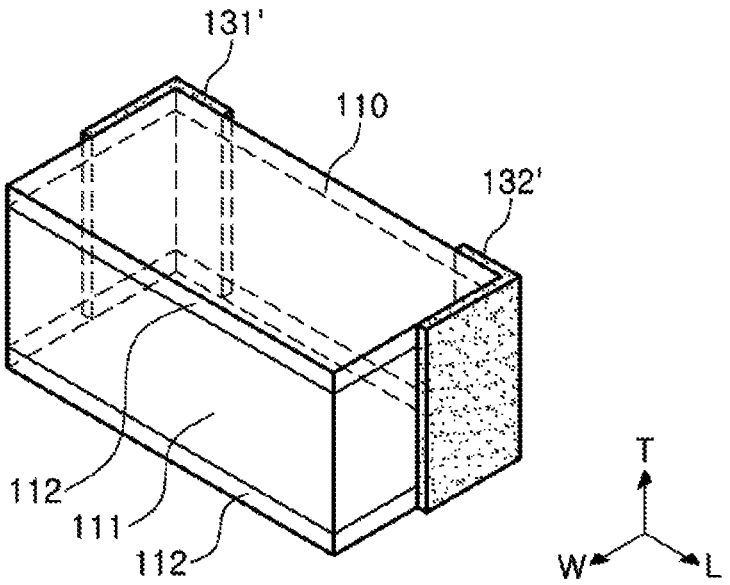

In another exemplary embodiment shown in FIG. 7, a position in which external electrodes are disposed may be changed relative to the embodiment of FIG. 1. In this case, the body portion 110 may have the same structure as that in FIG. 1. However, in the modified example, external electrodes 131' and 132' may be formed in regions corresponding to the connection patterns 122, for example in corner regions of the body portion 110. As a region occupied by the external electrodes 131' and 132' in the body portion 110 is significantly reduced, a reduction in characteristics, for example, parasitic capacitance or the like, unnecessarily generated by the coil patterns and the external electrodes 131' and 132', may be reduced.

Method of Manufacturing Coil Electronic Component

Hereinafter, an example of a method of manufacturing a coil electronic component having the structure described above will be described with reference to FIGS. 10 to 15.

Figure 10:
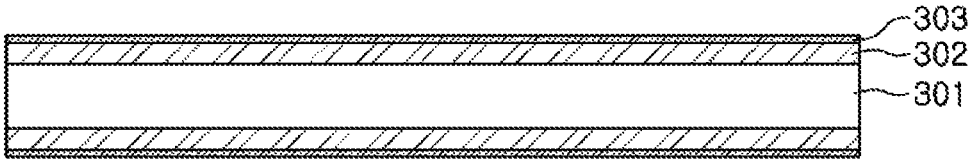
FIGS. 10 to 15 are cross sectional views illustrating sequential process steps of a method of manufacturing a coil electronic component according to an exemplary embodiment.
Figure 11:
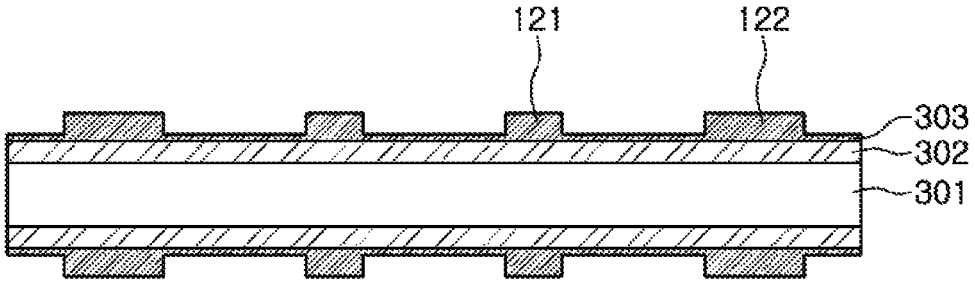

As described above, a coil electronic component may be manufactured using a method in which coil layers 101 and reinforcing layers 112 are batch laminated. As an example thereof, an individual coil layer 101 including an insulating layer 111, a coil pattern 121, a first conductivity type via 123, and the like may be manufactured as illustrated in FIGS. 10 to 14. In detail, as illustrated in FIGS. 10 and 11, a carrier layer 301 may be formed and coil patterns 121 may be formed on a surface of the carrier layer 301. In this case, connection patterns 122 may be formed together with the formation of the coil patterns 121. The carrier layer 301 may be formed of a material such as a thermosetting resin, and copper-clad layers 302 and 303 may be formed on the surface of the carrier layer 301. Thus, the carrier layer 301 may be provided in a form of a copper-clad laminate. The copper-clad layers 302 and 303 may be provided for use as a seed for the formation of the coil pattern 121, a function of easily separating the carrier layer 301 in a subsequent process, or the like, or may be omitted in other exemplary embodiments.

The coil pattern 121 and the connection pattern 122 may be obtained by laminating a mask layer on the copper-clad layer 303 to be patterned and then be plated with Cu or the like. Then, the mask layer may be removed therefrom. The coil pattern 121 and the connection pattern 122 may be formed on both upper and lower surfaces of the carrier layer 301, so as to form two coil layers 101 through a single process.

Figure 12:
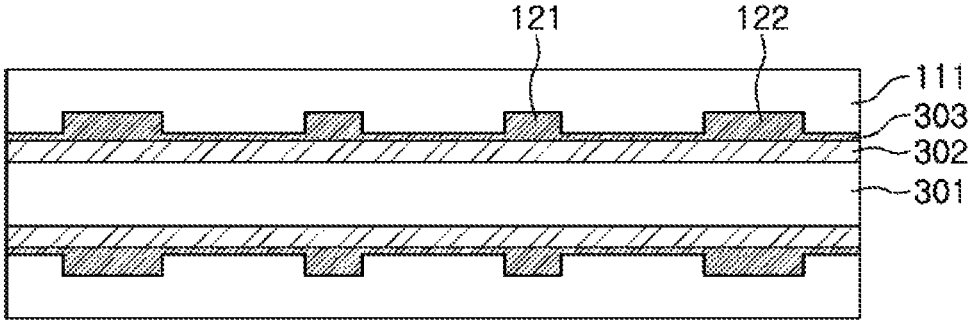

Subsequently, as illustrated in FIG. 12, an insulating layer 111 may be formed to cover the coil patterns 121 and the connection patterns 122. The insulating layer 111 may be formed on both upper and lower surfaces of the carrier layer 301 to cover the coil patterns 121 and the connection patterns 122 formed on the upper and lower surfaces of the carrier layer 301. As described above, the insulating layer 111 may be formed using a photosensitive insulating material and may be covered using, for example, a vacuum laminator. In this case, the insulating layer 111 may have a thickness of about 10 um to 80 um, and may include a metal or a ceramic filler according to the use thereof. In addition, a degree of hardness of the insulating layer 111 may be controlled by an amount of photosensitive material contained in the insulating layer 111. A mixture obtained by mixing two or more types of materials, for example, a thermosetting material and a photosensitive material, with each other may be used.

Figure 13:
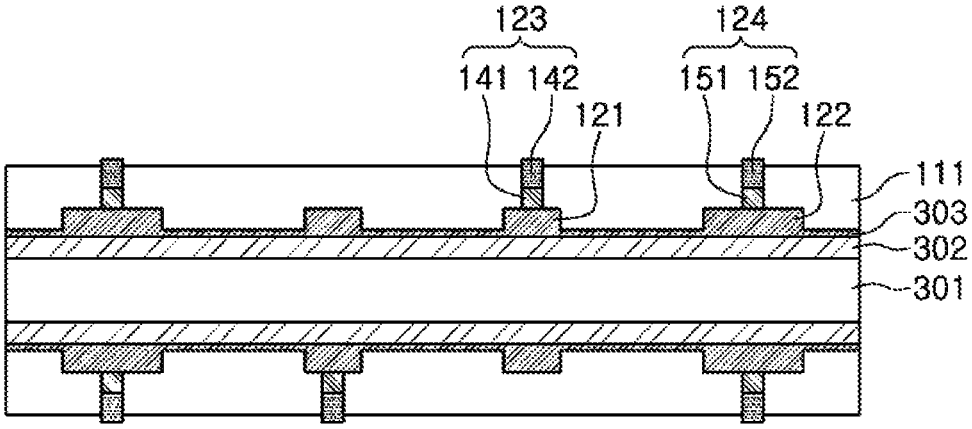

Then, as illustrated in FIG. 13, the first conductivity type via 123 may be formed to be connected to the coil pattern 121. To this end, the insulating layer 111 formed of a photosensitive insulating material may be exposed to ultraviolet (UV) light or the like to be developed, to form a through hole. The through hole may be formed at a position vertically aligned with the coil pattern 121. Then, a Cu layer 141 and the Sn layer 142 may be formed to fill the through hole using a plating method. In addition, by using the method described above, a second conductivity type via 124 including a Cu layer 151 and an Sn layer 152 may be formed at a position vertically aligned with the connection pattern 122.

Figure 14:
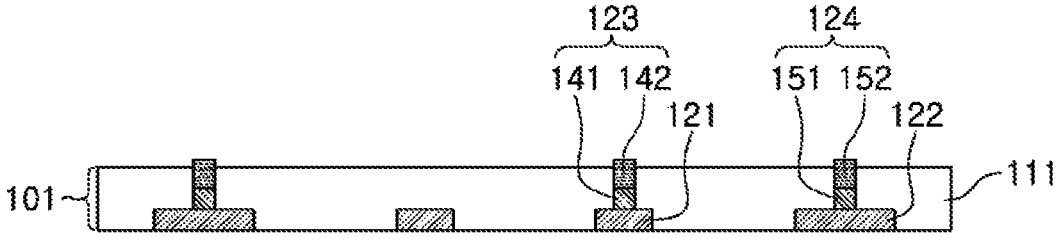
Figure 15:
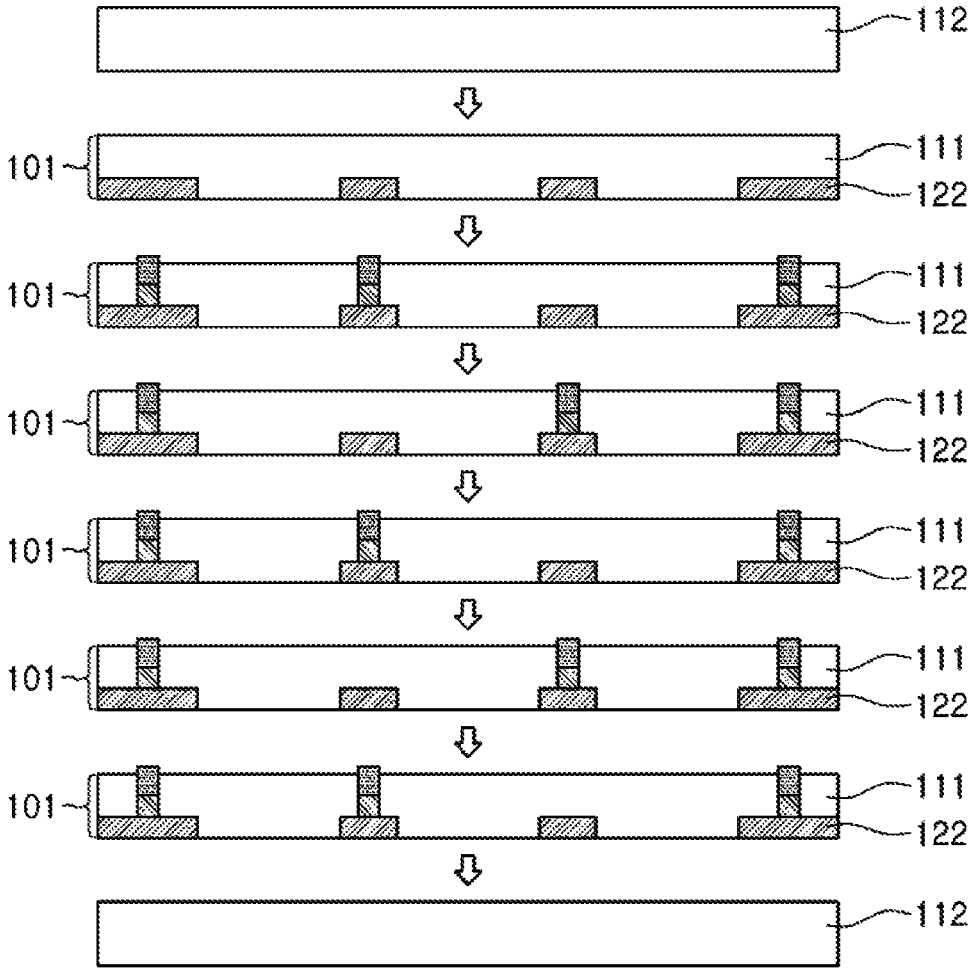

Next, as illustrated in FIG. 14, individual coil layers 101 may be obtained by separating the carrier layer 301 from the coil layer 101. One coil layer 101 is only illustrated in FIG. 14. As described above, the carrier layer 301 may be easily separated from the coil layer 101 by the copper-clad layer 302. In addition, in the case of the copper-clad layer 303 remaining in a lower portion of the coil layer 101, the remaining copper-clad layer 303 may be removed through an etching process suitable therefor.

Through the processes described above, the individual coil layers 101 may be manufactured in a required number thereof. In this case, the shape of the coil pattern 121, the connection pattern 122, and the like included in the respective coil layers 101 may be different from each other. Separately from the manufacturing of the coil layers 101, a reinforcing layer 112 having greater rigidity than that of the insulating layer 111 may be manufactured. The reinforcing layer 112 may be formed by including a relatively large amount of ceramic filler in an insulating resin. The coil layer 101 and the reinforcing layer 112 obtained as above may be batch laminated in a form illustrated in FIG. 15. In this case, a laminated structure may be obtained by applying heat and pressure thereto. In this case, the reinforcing layer 112 may be provided as uppermost and lowermost layers to increase rigidity.

The body portion obtained as above may implement a stable interlayer combination such as that shown in FIG. 3 without a separate sintering process. Then, external electrodes 131 and 132 may be formed on outer surfaces of the body portion, to thus implement the coil electronic component 100. The external electrodes 131 and 132 may be formed by applying a conductive paste or using a plating process or the like.

As in the exemplary embodiment, the coil layers 101 and the reinforcing layers 112, which have been manufactured in advance, may be batch laminated, to form a body portion. Thus, as compared to a method in which respective layers are sequentially laminated, the number of overall processes and a process time may be reduced, thereby leading to reduction in process costs. In addition, in the case of the manufacturing method according to the exemplary embodiment, the specifications of the coil electronic component 100 such as the size thereof, electrical characteristics thereof, and the like may be effectively implemented by properly controlling the number or thickness of the coil layers 101. However, although the exemplary embodiment illustrates that the coil layers 101 and the reinforcing layers 112 are batch laminated, the coil layers 101 and the reinforcing layers 112 may also be laminated through being divided twice or more, according to the numbers of the coil layers 101 and the reinforcing layers 112.

As set forth above, with a coil electronic component according to the exemplary embodiments presented in the present disclosure, structural stability and reliability may be improved. In addition, such coil electronic components may be effectively manufactured using a batch lamination method.

While example embodiments have been shown and described above, it will be apparent to those skilled in the art that modifications and variations could be made without departing from the scope of the present disclosure as defined by the appended claims.

What is claimed is:

1. A coil electronic component comprising:

a body portion including a coil layer and a reinforcing layer disposed on at least one of an upper portion or a lower portion of the coil layer; and an external electrode disposed on an outer surface of the body portion, wherein the coil layer includes an insulating layer, a coil pattern, and a first conductive via penetrating through the insulating layer to be connected to the coil pattern, the reinforcing layer has a higher degree of rigidity than the insulating layer, the reinforcing layer is free of a portion of the coil pattern, and the first conductive via includes a metal layer disposed on the coil pattern and an intermetallic compound disposed on the metal layer such that a side surface of the metal layer directly contacts the insulating layer.

2. The coil electronic component of claim 1, wherein the insulating layer includes a photosensitive insulating material.

3. The coil electronic component of claim 1, wherein the coil layer further comprises a connection pattern disposed in a corner of the insulating layer and connected to the external electrode.

4. The coil electronic component of claim 3, wherein the body portion includes a plurality of coil layers laminated in a stacking direction, each of the plurality of coil layers includes an insulating layer, a coil pattern, a first conductive via penetrating through the insulating layer to be connected to the coil pattern, and a connection pattern disposed in a corner of the insulating layer, and each of the plurality of coil layers further includes a second conductive via penetrating through the insulating layer to be connected to the connection pattern.

5. The coil electronic component of claim 4, wherein the coil pattern and the connection pattern are connected to each other in an uppermost coil layer and in a lowermost coil layer of the plurality of coil layers.

6. The coil electronic component of claim 5, wherein the coil pattern and the connection pattern are disconnected from each other in each of the plurality of coil layers other than the uppermost coil layer and the lowermost coil layer.

7. The coil electronic component of claim 4, wherein the second conductive via includes a copper (Cu) layer and a tin (Sn) layer laminated together.

8. The coil electronic component of claim 4, wherein the second conductive via in each respective coil layer is disposed in the respective coil layer in a position which does not overlap with a position of other second conductive vias included in coil layers adjacent to the respective coil layer in a lamination direction.

9. The coil electronic component of claim 4, wherein the second conductive via has an integrated structure penetrating through all of the plurality of coil layers.

10. The coil electronic component of claim 3, wherein the connection pattern has an 'L' shape when viewed from above.

11. The coil electronic component of claim 3, further comprising a pad layer disposed between the coil layer and the reinforcing layer, the pad layer including a connection pattern connected to the external electrode and not including a coil pattern.

12. The coil electronic component of claim 1, wherein the coil pattern is partially embedded in the insulating layer and a surface of the coil pattern is exposed through a surface of the insulating layer.

13. The coil electronic component of claim 1, wherein a Young's modulus of the reinforcing layer is 12 GPa or more.

14. The coil electronic component of claim 1, wherein the metal layer includes a Cu layer and a Sn layer laminated together.

15. The coil electronic component of claim 14, wherein the intermetallic compound is disposed at an interface between the Sn layer and the coil pattern.

16. The coil electronic component of claim 1, wherein the body portion has a structure that is asymmetrical in a vertical direction around a central surface of the body portion.

17. The coil electronic component of claim 1, wherein the body portion comprises:

a plurality of coil layers laminated in a stacking direction, and a core portion disposed in a central portion of the laminated stack of coil layers, wherein the coil layers are disposed on upper and lower portions of the core portion.

18. The coil electronic component of claim 17, wherein among the coil layers, first conductive vias included in the coil layers disposed on upper and lower portions of the core portion are disposed in surfaces of the coil layers facing the core portion.

19. The coil electronic component of claim 17, wherein the core portion is a copper-clad laminate.

20. A coil electronic component, comprising:

a body portion including a coil layer and a reinforcing layer disposed on at least one of an upper portion or a lower portion of the coil layer, wherein the coil layer includes an insulating layer, a coil pattern, and a first conductive via, the reinforcing layer has a higher content of a ceramic filler than the insulating layer, the reinforcing layer has a higher degree of rigidity than the insulating layer, the reinforcing layer is free of a portion of the coil layer, and the first conductive via includes a metal layer disposed on the coil pattern and an intermetallic compound disposed on the metal layer such that a side surface of the metal layer directly contacts the insulating layer.

21. The coil electronic component of claim 20, wherein the insulating layer includes a mixture of the ceramic filler and a photosensitive material, the reinforcing layer includes the ceramic filler and an insulating resin, and a content of the ceramic filler in the reinforcing layer is higher than a content of the ceramic filler in the insulating layer.

22. The coil electronic component of claim 20, wherein the body portion includes a plurality of coil layers laminated in a stacking direction, and each of the plurality of coil layers includes an insulating layer, a coil pattern, and a first conductive via penetrating through the insulating layer to be connected to the coil pattern.

23. The coil electronic component of claim 22, wherein the first conductive via in each respective coil layer is disposed in the respective coil layer in a position which does not overlap with a position of other first conductive vias included in coil layers adjacent to the respective coil layer in a lamination direction.

24. The coil electronic component of claim 22, wherein each of the plurality of coil layers further includes:

a connection pattern disposed in a corner of the insulating layer, and a second conductive via penetrating through the insulating layer to be connected to the connection pattern.

25. The coil electronic component of claim 24, wherein the second conductive via in each respective coil layer is disposed in the respective coil layer in a position which does not overlap with a position of other second conductive vias included in coil layers adjacent to the respective coil layer in a lamination direction.

26. The coil electronic component of claim 20, wherein the body portion comprises:

a plurality of coil layers laminated in a stacking direction, and a core portion disposed in a central portion of the laminated stack of coil layers, wherein the coil layers are disposed on upper and lower portions of the core portion.

27. The coil electronic component of claim 20, wherein a Young's modulus of the reinforcing layer is 12 GPa or more.

28. A coil electronic component comprising:

a body portion including a plurality of coil layers laminated in a stacking direction, and a reinforcing layer disposed on at least one of an upper portion and a lower portion of the laminated stack of coil layer, wherein each respective coil layer includes an insulating layer, a coil pattern, and a first conductive via penetrating through the insulating layer and disposed in the respective coil layer in a position which does not overlap with a position of other first conductive vias included in coil layers adjacent to the respective coil layer in the stacking direction, the reinforcing layer is free of a portion of the plurality of coil layers, and at least one of the first conductive vias includes a metal layer disposed on the coil pattern and an intermetallic compound disposed on the metal layer such that a side surface of the metal layer directly contacts the insulating layer.

29. The coil electronic component of claim 28, wherein the reinforcing layer has a higher degree of rigidity than the insulating layer.

30. The coil electronic component of claim 28, wherein each of the plurality of coil layers further includes a connection pattern disposed in a corner of the insulating layer, and the first conductive via penetrates through the insulating layer to be connected to the connection pattern.

31. The coil electronic component of claim 28, wherein each first conductive via penetrates through the insulating layer to be connected to the coil pattern.

32. The coil electronic component of claim 31, wherein each of the plurality of coil layers further includes:

a connection pattern disposed in a corner of the insulating layer, and a second conductive via penetrating through the insulating layer to be connected to the connection pattern, wherein the second conductive via in each respective coil layer is disposed in the respective coil layer in a position which does not overlap with a position of other second conductive vias included in coil layers adjacent to the respective coil layer in a lamination direction.

* * * * *